US005704764A

United States Patent [19]

Chupp et al.

[11] Patent Number: 5,704,764

[45] Date of Patent: Jan. 6, 1998

[54] TURBINE INTER-DISK CAVITY COOLING AIR COMPRESSOR

[75] Inventors: Raymond E. Chupp; David A. Little, both of Oviedo, Fla.

[73] Assignee: Westinghouse Electric Corporation, Pittsburgh, Pa.

[21] Appl. No.: 730,720

[22] Filed: Oct. 7, 1996

[51] Int. Cl.[6] ..... F01D 5/06; F01D 5/08

[52] U.S. Cl. ..... 416/97 R; 416/95; 416/198 A; 415/115; 415/177; 415/178

[58] Field of Search ..... 415/115, 116, 415/177, 178, 179; 416/95, 96 R, 96 A, 97 R, 198 A

[56] References Cited

U.S. PATENT DOCUMENTS

| | | | |
|---|---|---|---|
| 2,648,519 | 8/1953 | Campini | 416/95 |
| 5,120,192 | 6/1992 | Ohtomo et al. | 416/96 A |
| 5,269,653 | 12/1993 | Evans | 416/97 R |
| 5,468,125 | 11/1995 | Okpara et al. | 416/97 R |
| 5,507,620 | 4/1996 | Primoschitz et al. | 416/96 R |

*Primary Examiner*—Christopher Verdier

*Attorney, Agent, or Firm*—R. P. Lenart

[57] ABSTRACT

The inter-disk cavity between turbine rotor disks is used to pressurize cooling air. A plurality of ridges extend radially outwardly over the face of the rotor disks. When the rotor disks are rotated, the ridges cause the inter-disk cavity to compress air coolant flowing through the inter-disk cavity en route to the rotor blades. The ridges eliminate the need for an external compressor to pressurize the air coolant.

13 Claims, 4 Drawing Sheets

TURBINE INTER-DISK CAVITY COOLING AIR COMPRESSOR

STATEMENT OF GOVERNMENT INTEREST

The United States Government has rights in this invention pursuant to Contract No. DE-AC21-93MC30247 with the Department of Energy.

FIELD OF THE INVENTION

The invention relates to compressor systems for use with turbine engines. More particularly, the invention relates to the use of the regions between turbine disks to compress rotor cooling air that is flowing radially outward.

BACKGROUND OF THE INVENTION

Pressurized air is among the more common cooling mediums used to cool the components in gas turbine engines. Generally in such systems, compressed air is drawn from the combustor shell and used to cool components of the turbine engine, e.g., the vanes, the blades and the combustors. Typically, the air is first filtered and cooled before its use as a coolant. Additionally, in closed loop cooling systems, the air is returned to the compressor after its use in cooling. In such a closed loop system, the cooling air must be sufficiently pressurized in order to re-enter the compressor. Unfortunately, within the cooling circuit, the air generally experiences a pressure loss.

As the air coolant follows a typical cooling circuit, it undergoes pressure drops due to resistances of bonds, orifices and the like. To overcome these pressure drops, in some applications the air coolant is routed out of the turbine engine to an external compressor before re-injection into the cooling circuit. At the external compressor, the air coolant is compressed about 60 PSI. Significantly, external compressors are expensive components, with costs in the $300,000 range. Other costs are associated with the use of external compressors, e.g., back up compressors, piping, operation, maintenance, floor space and the like. Applicants have recognized that a turbine engine that internally provides the pressurization required by the air coolant would eliminate the need for external compressors, thereby providing substantial economic benefits.

Thus, there is a need for an apparatus that functions within a turbine and compresses the coolant air while eliminating the need for an external compressor.

SUMMARY OF THE INVENTION

The present system meets the needs stated above by providing an apparatus for compressing air within the turbine engine. The apparatus comprises at least two rotor disks coupled together at an axis of rotation so that the rotor disks rotate substantially about the axis. Space between each set of rotor disks forms an inter-disk cavity. An air inlet is located near the axis of rotation and supplies an air flow to the inter-disk cavity. A plurality of ridges is coupled to at least one of the rotor disk faces of adjacent rotor disks, such that the air flow through the inter-disk cavity is compressed and forced radially outwardly from the inter-disk cavity when the rotor disks rotate.

According to the presently preferred embodiments, the cross-section of the ridges is triangular or rectangular. Additionally, the ridges can be formed as part of the rotor disk face or, alternatively, can be attached via attachment bolts or some equivalent attachment means.

BRIEF DESCRIPTION OF THE DRAWINGS

The foregoing summary, as well as the following detailed description of the preferred embodiments, is better understood when read in conjunction with the appended drawings. For the purpose of illustrating the invention, there is shown in the drawings an embodiment that is presently preferred, it being understood, however, that the invention is not limited to the specific methods and instrumentalities disclosed.

In the drawings.

DETAILED DESCRIPTION OF A PREFERRED EMBODIMENT

Figure 1:
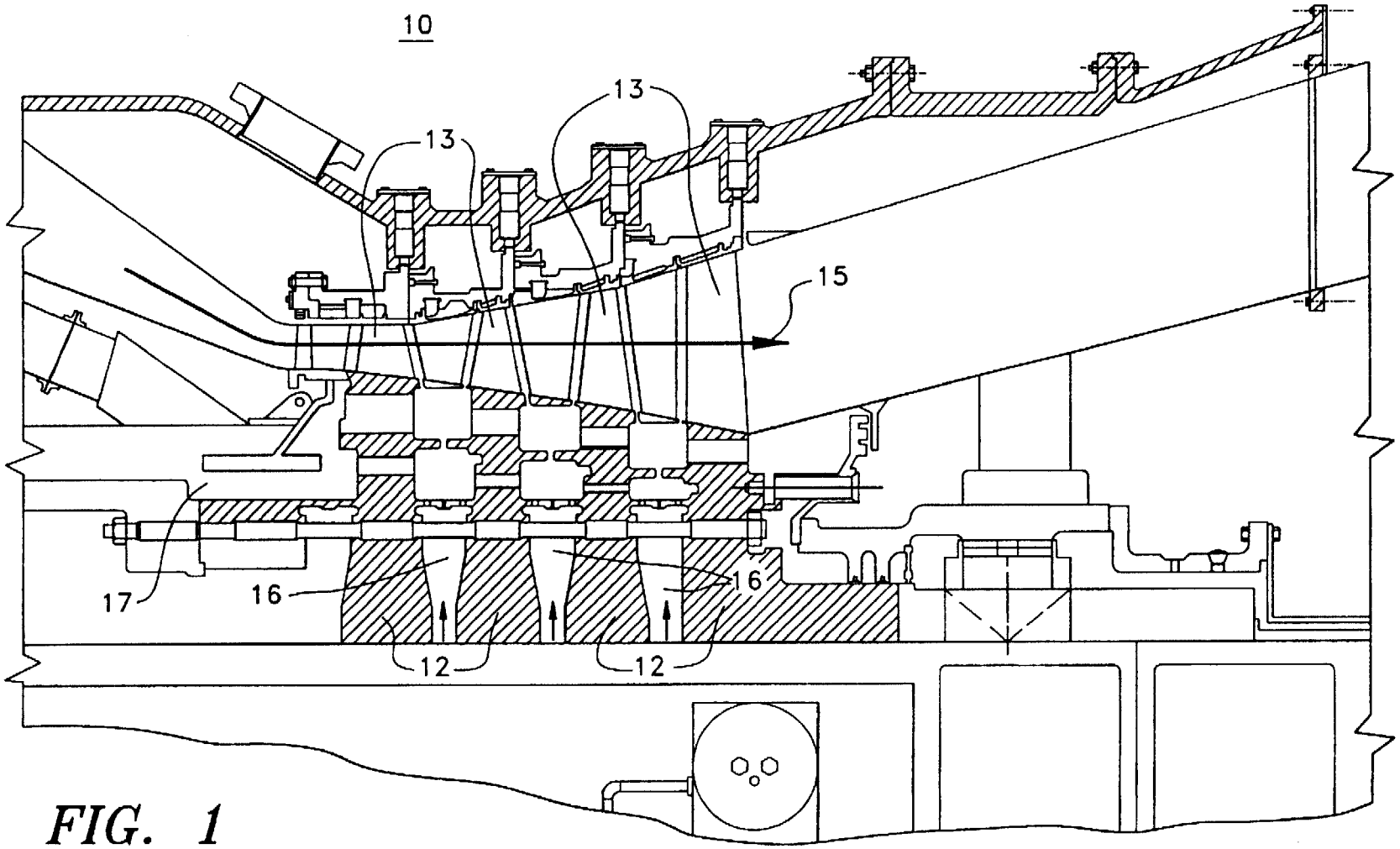
FIG. 1 is a sectional view of a turbine section of a turbine engine wherein the present invention may be employed.

Referring now to the drawings wherein like numerals indicate like elements throughout, FIG. 1 presents a diagram of a turbine 10 portion of a gas turbine engine wherein the present invention may be employed. As shown in FIG. 1, the turbine 10 comprises a plurality of turbine rotor disks 12. These rotor disks 12 are arranged in parallel planes to form a turbine shaft, which is rotatably disposed within the turbine 10. An inter-disk cavity 16 is formed by the space between the rotor disks 12. The rotor disks 12 can then rotate in tandem within the turbine 10. Rotor blades 13, which are attached to the rotor disks 12, are disposed within the hot gas path 15. As the hot gas expands axially through the turbine 10, the rotor blades 13 and rotor disk 12 assembly are caused to rotate.

Coolant must be provided to the rotor blades 13 as well as other turbine engine components because of the exposure to extreme heat from the hot gas expanding through the turbine 10. In a presently preferred embodiment of the present invention, the coolant comprises air; however, persons skilled in the art will appreciate that other gases or combinations of gases, such as steam, can be substituted for the air without affecting the function or novelty of the present invention.

Figure 1A:
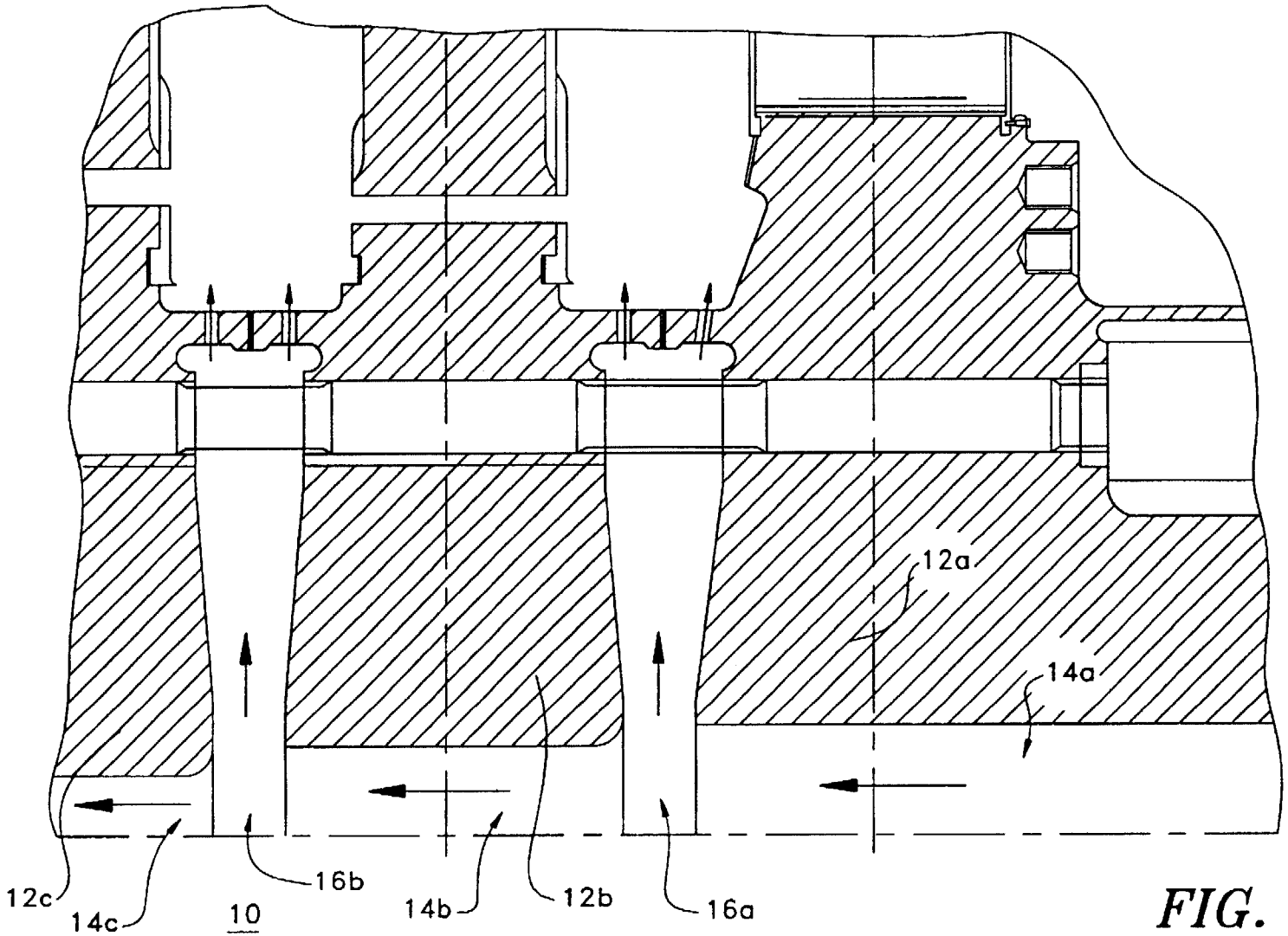
FIG. 1A is a sectional view of a portion of a gas turbine engine showing a portion of the air coolant path.

Referring now to FIG. 1A, the path of the air coolant is shown as it flows through the turbine 10 to reach the rotor blades 13. In the presently preferred embodiment, the air coolant flows through the turbine 10 from the rear of the turbine 10 toward the front of the turbine 10. As will be explained more fully below, along the coolant flow path, a portion of the air coolant is shunted off to provide the coolant needs for each set of rotor blades 13.

The air coolant flows through each rotor disk 12 via a duct 14. In particular, the air coolant enters the last rotor disk **12*a* via duct 14*a*. The air coolant then enters the inter-disk cavity 16*a*. As shown, a portion of the air coolant is shunted outwardly through the inter-disk cavity 16*a* to provide the coolant needs for the rotor blades 13. The remaining air coolant continues traveling through the turbine 10 via duct 14*b* in rotor disk 12*b*. After traveling through rotor disk 12*b*, the air coolant enters the next inter-disk cavity 16*b*. Again, a portion of the air is shunted outwardly to provide the cooling needs of the next set of rotor blades 13. Subsequently, another portion of the coolant air enters the next disk 12***c* via duct 14*c*.

As indicated above, the air coolant must be pressurized before entering the rotor blades 13. According to the present invention, the pressurization is provided by the rotor disks 12 and the inter-disk cavity. Essentially, the air coolant enters the inter-disk cavities 16*a*, 16*b*. Therein, the air pressure must be increased to provide pressure higher than compressor discharge pressure at the exit of the cooling air circuit 17. According to an aspect of the present invention, the air pressure increase is gained via the rotation of the rotor disks 12.

A series of ridges 30 are disposed within the inter-disk cavities 16 to increase the pressure of the air coolant as it flows outwardly. In the presently preferred embodiments, as explained more fully below, the ridges 30 can be attached to one side of the inter-disk cavity 16, i.e., to only one of the faces of the rotor disk 12, or, alternatively, the ridges 30 can be attached to both sides of the inter-disk cavity 16, i.e., both faces of the rotor disk 12.

Figure 2:
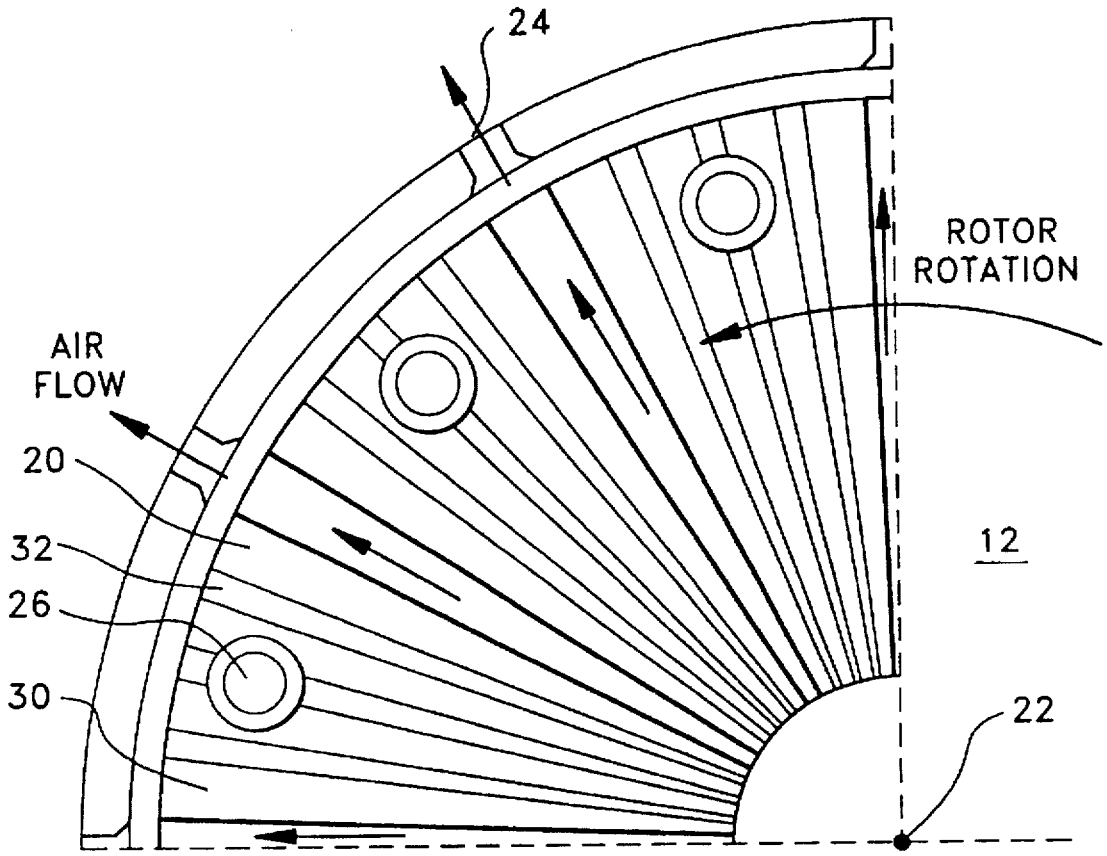
FIG. 2 is a front sectional view of a portion of a rotor disk employing aspects of the present invention.
Figure 3:
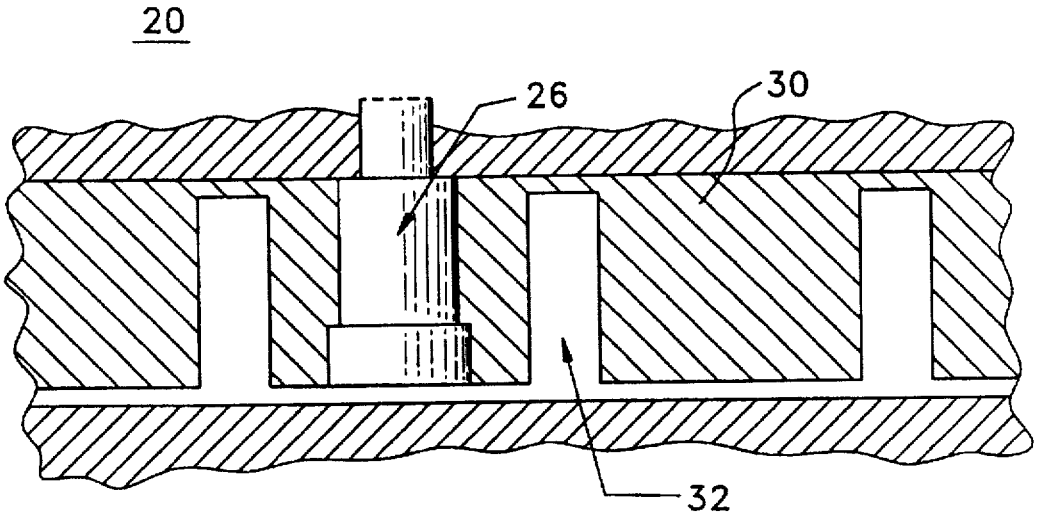
FIG. 3 is a view of a presently preferred embodiment of the present invention within the rotor disk inter-cavity wherein the geometric shape of the ridges is rectangular; and, FIG. 4 is a sectional view of a presently preferred embodiment of the present invention within the rotor disk inter-cavity wherein the geometric shape of the ridges is triangular.

Referring now to FIGS. 2 and 3, the face of a portion of a rotor disk 12 having the ridges 30 of the present invention is depicted. In a presently preferred embodiment, spacers 20 are attached to the face of the rotor disk 12. The spacers 20 are configured with ridges such that as each rotor disk 12 rotates about its axis 22, the pressure of the air coolant flowing out through the inter-disk cavity outlets 24 is increased. The spacers 20 are attached to the rotor disk 12 via thru bolts 26. As best shown in FIG. 3, each spacer 20 comprises a series of ridges 30 that extend radially outward from the center toward the periphery of the rotor disk 12. Those skilled in the art will recognize that the length of the ridges shown in FIG. 3, although depicted with straight lines, may be a variety of shapes, such as curved lines. The cross-section of the ridges 30 shows that the ridges 30 have a rectangular cross-section. Air passages 32 remain between the ridges 30. As the rotor disk 12 rotates about the turbine shaft, the pressure flowing through the air passages 32 is greatly increased, i.e., on the order of 50 psi. Thus, the pressure rise within the inter-disk cavity 16 approaches that of an external compressor.

Figure 4:
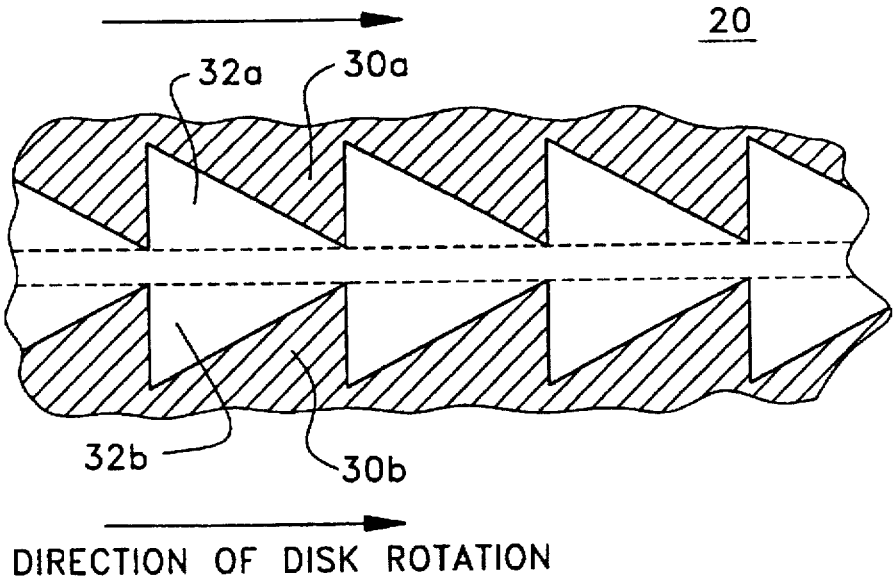

Referring now to FIG. 4, another presently preferred embodiment of the present invention is illustrated. As shown, in this embodiment, the ridges 30*a* and 30*b* rise off of both rotor disk faces that form the inter-disk cavity to form air passages 32*a* and 32*b*. Moreover, the ridges 30*a* and 30*b* are not formed of separate spacers that are attached to the face of the rotor disk 12, but rather are formed as part of the face of the rotor disk 12. The rotor disk 12 can be machined to create the ridges 30*a* and 30*b* with the desired cross-section or, alternatively, cast as a single rotor disk 12 having ridges 30*a* and 30*b* with the desired cross-section.

The present invention may be embodied in other specific forms without departing from the spirit or essential attributes thereof; for example, square ridges or some other shaped ridge cross-section could be used to generate the inter-disk cavity pressure. Accordingly, reference should be made to the appended claims, rather than to the foregoing specification, as indicating the scope of the invention.

What is claimed is:

1. In a turbine engine, an apparatus for compressing a cooling medium, comprising:

at least two rotor disks coupled together to form a shaft within the turbine engine at an axis of rotation for rotation substantially about said axis, wherein a space between the rotor disks forms an inter-disk cavity;

a cooling medium inlet located proximately near the axis of rotation for supplying the cooling medium to the inter-disk cavity; and, a plurality of ridges coupled to a face of at least one rotor disk of adjacent rotor disks and extending radially outward such that the cooling medium flow through the inter-disk cavity is compressed and forced radially outwardly from said inter-disk cavity when the rotor disks rotate.

2. The apparatus as recited in claim 1, wherein said ridges are coupled to the at least one rotor disk face via attachment bolts.

3. The apparatus as recited in claim 1, wherein said ridges extend substantially radially from the center of the at least one rotor disk face toward the periphery of the at least one rotor disk face.

4. The apparatus as recited in claim 3, wherein said ridges have a cross-section, said cross section being substantially one of a rectangle and a triangle.

5. The apparatus as recited in claim 1, wherein said cooling medium comprises a gas.

6. The apparatus as recited in claim 5, wherein said gas comprises air.

7. The apparatus as recited in claim 5, wherein said gas comprises steam.

8. In a turbine engine, an apparatus for compressing a cooling medium for use in cooling rotor blades, comprising:

at least two rotor disks coupled together, wherein said rotor disks are arranged substantially parallel to each other forming an axis of rotation substantially axial to the turbine engine for rotation within the turbine engine, wherein a space between the at least two rotor disks forms an inter-disk cavity;

a cooling medium inlet located proximately near the axis of rotation of the rotor disks for supplying the cooling medium to the inter-disk cavity;

at least one ridge coupled to a face of at least one rotor disk of adjacent rotor disks and extending radially outward, wherein the pressure of the cooling medium exiting the inter-disk cavity increases when the rotor disks rotate.

9. The apparatus as recited in claim 8 wherein said cooling medium comprises gas.

10. The apparatus as recited in claim 9 wherein said gas comprises air.

11. The apparatus as recited in claim 9 wherein said gas comprises steam.

12. The apparatus as recited in claim 8 wherein said at least one ridge extends substantially across a radius of the at least one rotor disk face.

13. The apparatus as recited in claim 8 wherein said at least one ridge has a cross-section, said cross-section being substantially one of a rectangle and a triangle.

* * * * *